US008410406B1

(12) United States Patent
Kutz

(10) Patent No.: US 8,410,406 B1
(45) Date of Patent: Apr. 2, 2013

(54) HELICAL WIRE HEATING COIL ASSEMBLIES AND METHODS FOR ASSEMBLING HELICAL WIRE HEATING COIL ASSEMBLIES

(75) Inventor: Edward A. Kutz, Muskego, WI (US)

(73) Assignee: Nova Coil, Inc., Franklin, WI (US)

( * ) Notice: Subject to any disclaimer, the term of this patent is extended or adjusted under 35 U.S.C. 154(b) by 1217 days.

(21) Appl. No.: 12/203,728

(22) Filed: Sep. 3, 2008

(51) Int. Cl.
*H05B 3/06* (2006.01)
*H01C 3/14* (2006.01)

(52) U.S. Cl. ..... 219/542; 219/536; 219/537; 219/548

(58) Field of Classification Search ..... 219/536, 219/537
See application file for complete search history.

(56) References Cited

U.S. PATENT DOCUMENTS

| | | | | | |
|---|---|---|---|---|---|
| 3,846,619 | A * | 11/1974 | Wightman et al. | ..... | 219/532 |
| 3,867,047 | A * | 2/1975 | Wightman et al. | ..... | 403/242 |
| 3,890,487 | A * | 6/1975 | Wightman et al. | ..... | 219/532 |
| 4,481,411 | A * | 11/1984 | Roth | ..... | 219/532 |
| 4,692,599 | A * | 9/1987 | Howard et al. | ..... | 219/532 |
| 5,122,640 | A * | 6/1992 | Holmes | ..... | 219/532 |
| 5,324,919 | A * | 6/1994 | Howard et al. | ..... | 219/532 |
| 5,329,098 | A * | 7/1994 | Howard et al. | ..... | 219/532 |
| 5,954,983 | A * | 9/1999 | Holmes | ..... | 219/536 |
| 5,959,254 | A * | 9/1999 | Martin, Sr. | ..... | 174/138 J |
| 6,215,108 | B1 * | 4/2001 | Butcher et al. | ..... | 219/537 |
| 6,285,013 | B1 * | 9/2001 | Holmes | ..... | 219/536 |
| 6,376,814 | B2 | 4/2002 | Holmes | | |
| 6,509,554 | B2 * | 1/2003 | Howard et al. | ..... | 219/536 |
| 6,600,141 | B1 * | 7/2003 | Danko et al. | ..... | 219/532 |
| 2001/0006171 | A1 * | 7/2001 | Holmes | ..... | 219/536 |
| 2002/0139793 | A1 * | 10/2002 | Whitfield | ..... | 219/536 |
| 2003/0192877 | A1 * | 10/2003 | Danko et al. | ..... | 219/536 |

* cited by examiner

*Primary Examiner* — Joseph M Pelham
(74) *Attorney, Agent, or Firm* — Andrus, Sceales, Starke & Sawall, LLP

(57) ABSTRACT

Helical wire heating coil assemblies and methods of assembling helical heating coil assemblies are provided. In one example, a helical wire heating coil assembly includes first and second support frames that are detachably coupled together by a first plurality of insulating standoffs coupled to the first support frame, a second plurality of insulating standoffs coupled to the second support frame, and a helical wire heating coil coupled to both the first plurality of insulating standoffs and the second plurality of insulating standoffs.

20 Claims, 6 Drawing Sheets

HELICAL WIRE HEATING COIL ASSEMBLIES AND METHODS FOR ASSEMBLING HELICAL WIRE HEATING COIL ASSEMBLIES

FIELD

The present application relates to electric resistance heating elements. More particularly, the present application relates to helical wire heating coil assemblies and methods for assembling helical wire heating coil assemblies.

BACKGROUND

Electric heating elements utilizing helical wire heating coils are known in the art. Examples of such heating elements are taught in the applicant's U.S. Pat. Nos. 5,954,983; 6,285,013; and 6,376,814; which are incorporated herein by reference.

SUMMARY

Helical wire heating coil assemblies are provided. In one example, a helical wire heating coil assembly includes first and second support frames that are detachably coupled together by a first plurality of insulating standoffs coupled to the first support frame, a second plurality of insulating standoffs coupled to the second support frame, and a helical wire heating coil coupled to both the first plurality of insulating standoffs and the second plurality of insulating standoffs. The first and second support frames and the helical wire heating coil extend in an axial direction and the first and second pluralities of insulating standoffs extend from the first and second support frames, respectively, in a lateral direction that is perpendicular to the axial direction. Arms for supporting the insulating standoffs extend from either or both sides of the first and second support frames in a radial direction that is perpendicular to the axial direction and perpendicular to the lateral direction. The insulating standoffs have an elongated body portion extending between first and second ends, the body portion having a front face and a back face; a wedge portion formed on the first and second ends of the body portion, the wedge portion having a pair of angled ramp surfaces converging from the respective front and back faces of the body; and a coil groove formed in each of the front and back faces of the body, the coil groove being located adjacent the wedge portion.

Methods for assembling helical wire coil heating elements are also provided. In one example, the method includes the steps of: (a) providing a plurality of insulating standoffs, (b) providing first and second support frames having arms for holding insulating standoffs, (c) coupling standoffs from the plurality onto each of the arms, (d) providing a helical wire heating coil, (e) coupling each of the standoffs on the first support frame to the helical wire heating coil, and (f) coupling each of the standoffs on the second support frame to the helical wire heating coil to thereby couple the first support frame to the second support frame. The first and second support frames extend along an axial direction and the standoffs on the first frame extend upwardly in a lateral direction that is perpendicular to the axial direction and the standoffs on the second frame extend downwardly in the lateral direction. The helical heating coil extends in the axial direction between the first and second support frames. Step (f) can be completed in one step by moving the second support frame in the lateral direction towards the heating coil on the first support frame until the insulating standoffs on the second support frame snap engage with the heating coil.

BRIEF DESCRIPTION OF THE DRAWINGS

The best mode of carrying out the invention is described herein with reference to the following drawing figures.

DETAILED DESCRIPTION OF THE DRAWINGS

In the following description, certain terms have been used for brevity, clearness and understanding. No unnecessary limitations are to be implied therefrom beyond the requirement of the prior art because such terms are used for descriptive purposes only and are intended to be broadly construed. The different apparatuses and method steps described herein may be used alone or in combination with other apparatuses and method steps. It is to be expected that various equivalents, alternatives and modifications are possible within the scope of the appended claims.

Figure 1:
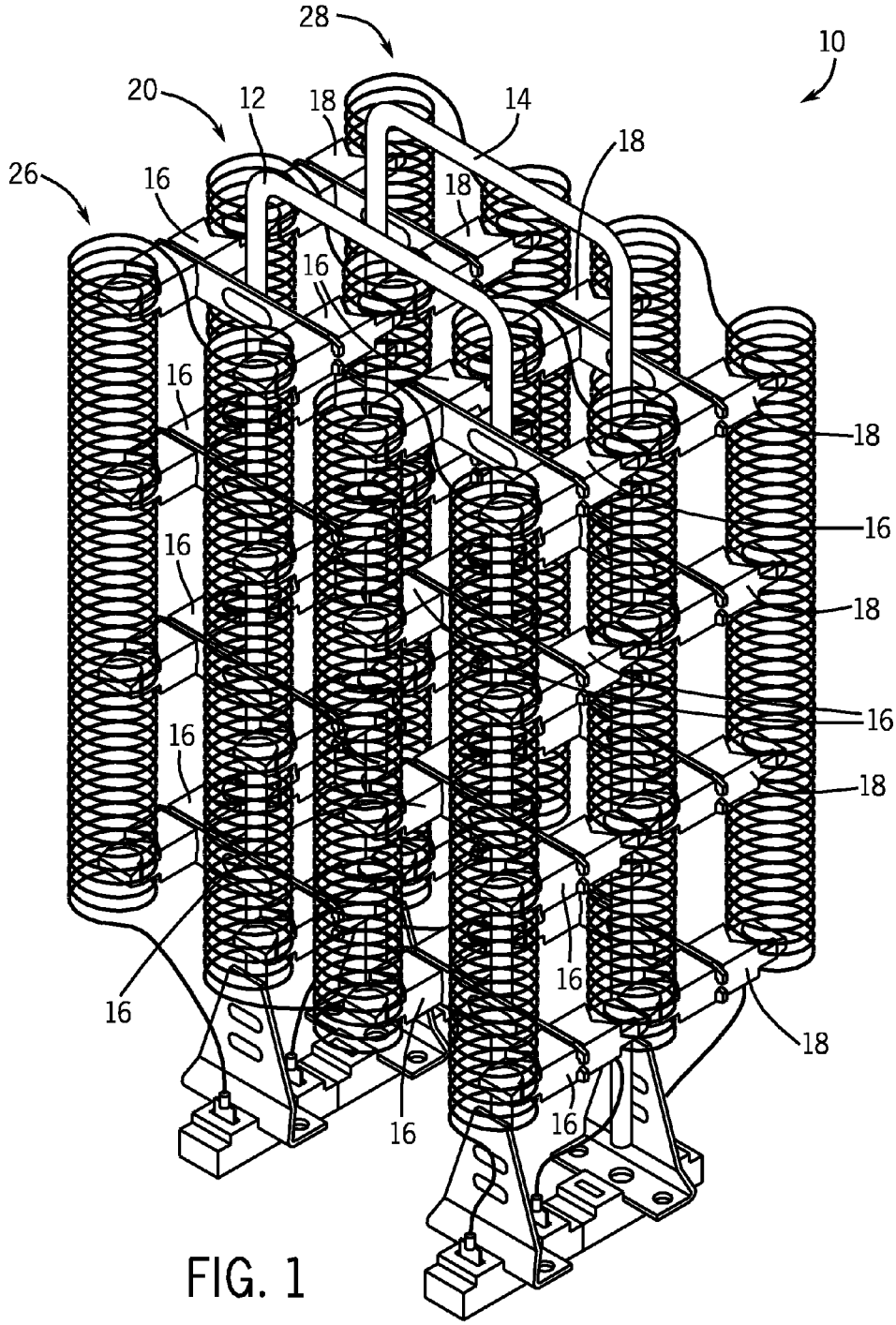
FIG. 1 is a perspective view of a helical wire heating coil assembly.

FIG. 1 depicts a helical wire heating coil assembly 10 having first and second support frames 12, 14 that are detachably coupled together by a first plurality of insulating standoffs 16 coupled to the first support frame 12, a second plurality of insulating standoffs 18 coupled to the second support frame 14, and a helical wire heating coil 20 coupled to both the first plurality of insulating standoffs 16 and the second plurality of insulating standoffs 18. The first and second support frames 12, 14 extend in an axial direction 22 and the first and second pluralities of insulating standoffs 16, 18 extend in a lateral direction 24 that is perpendicular to the axial direction 22. Second and third helical wire heating coils 26, 28 are coupled to the first and second pluralities of insulating standoffs 16, 18, respectively.

Figure 2:
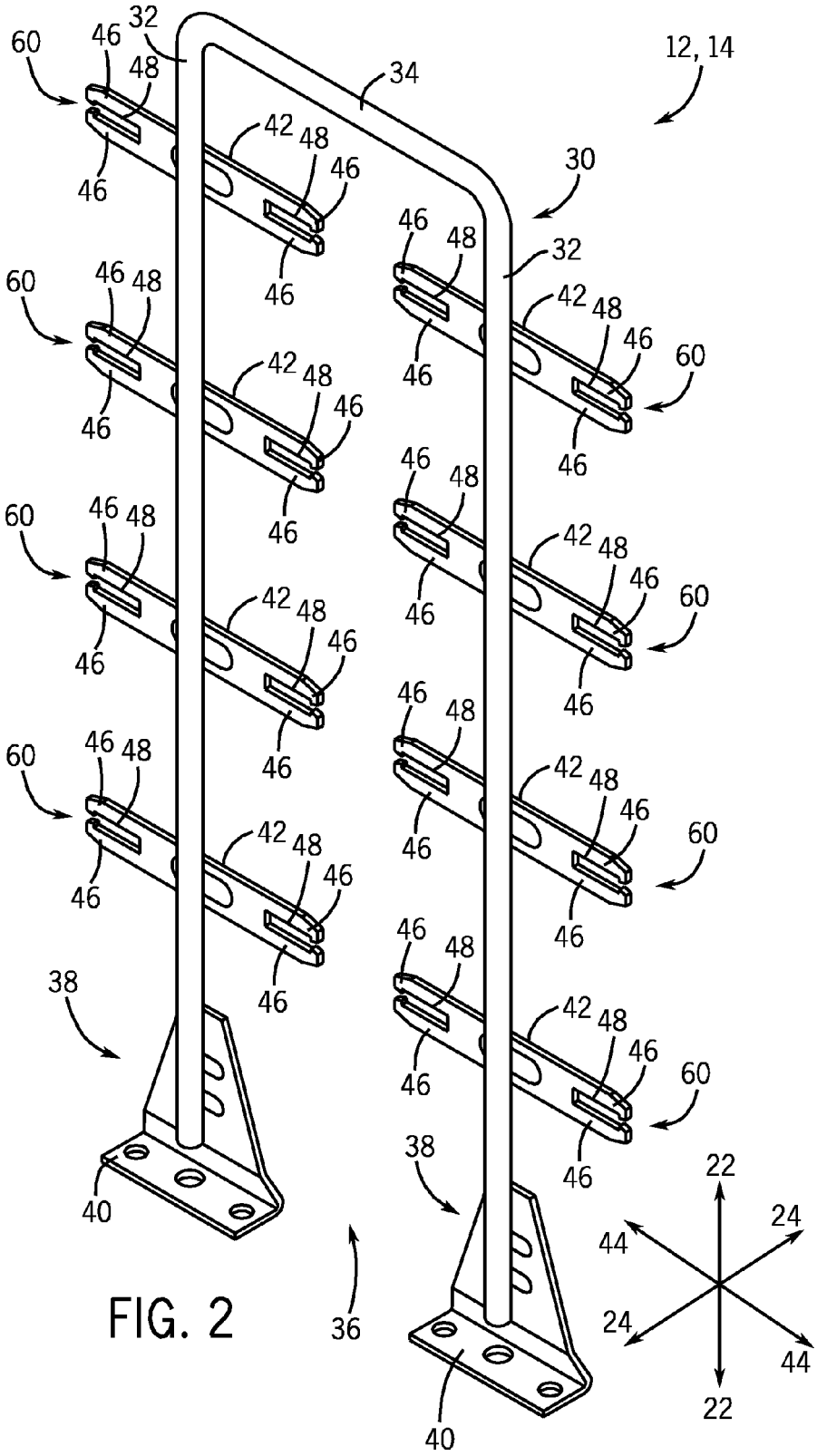
FIG. 2 is a perspective view of a support frame.

FIG. 2 depicts a support frame that is representative of both support frames 12, 14. The support frames 12, 14, include a U-shaped rail 30 having two axially elongated members 32, a first closed end 34 and a second open end 36 having two end portions 38. In a preferred example, the support frames 12, 14 are constructed from wire; however the support frames 12, 14 could also or alternately be stamped metallic elements formed of sufficient strength to support the standoffs. The end portions 38 include an angled support bracket 40 that is used as a point of attachment for the assembly to a mounting structure or within an appliance, a heating duct or the like, as will be discussed further below. In one example, the assembly 10 is mounted in a heating duct in such an orientation that air flows across heating coils 20, 26, 28 in the transverse direction 24.

Arms 42 extend outwardly in a radial direction 44 that is perpendicular to the axial direction 20 and perpendicular to the lateral direction 24. The arms 42 extend outwardly to both sides of the members 32 in the radial direction 44 and include a pair of tines 46. The tines 46 are spaced from each other such that the times 46 generally define an open slot 48 therebetween.

Figure 4:
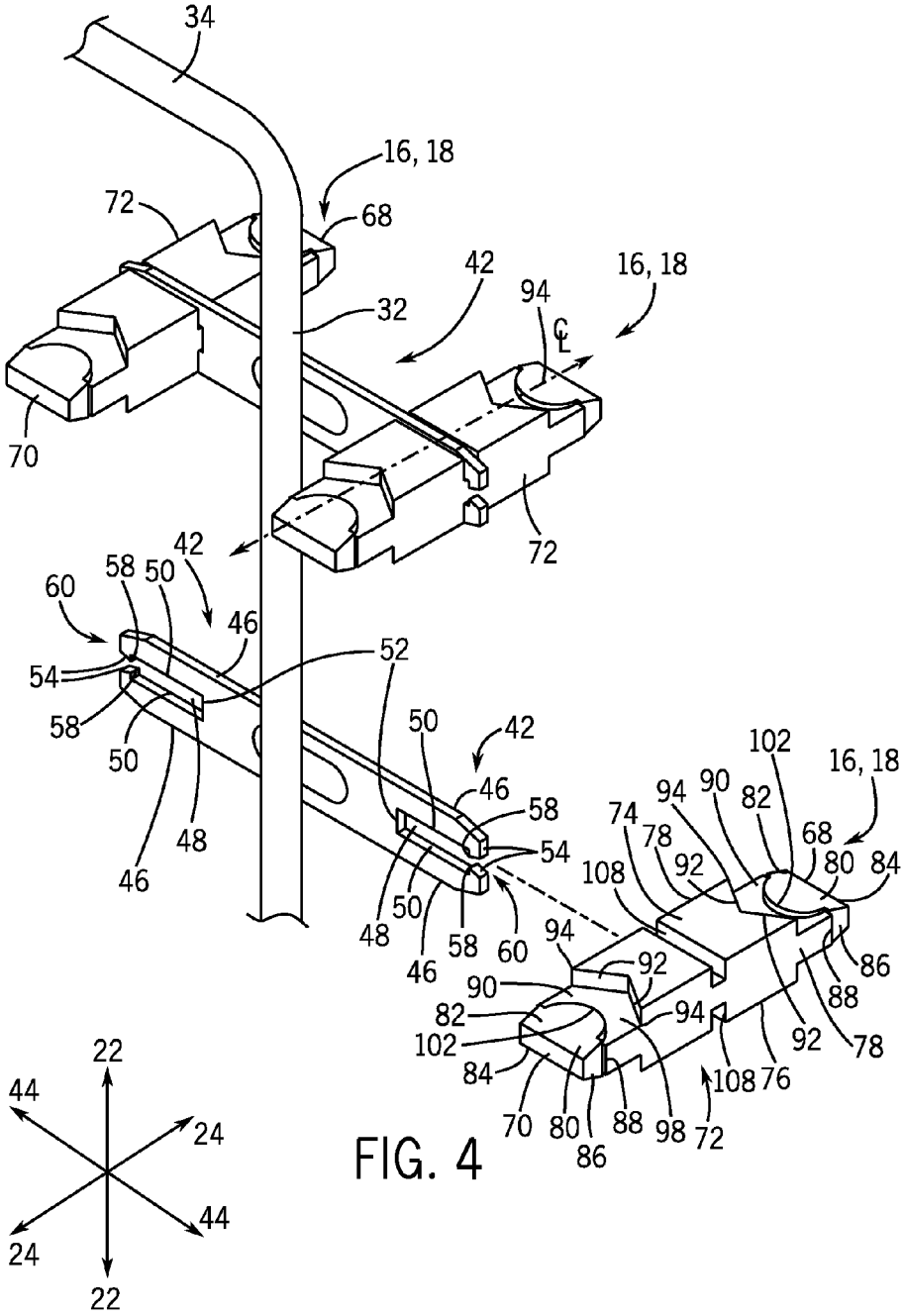
FIG. 4 is a perspective view of insulating standoffs being connected to arms on a support frame.

As shown in FIG. 4, the open slot 48 is defined by the inside edge 50 of each tine 46 and a back edge 52 formed on the arm 42. Each tine 46 terminates at its outmost edge with a tapered surface 54. The tapered surfaces 54 taper inward from the outer edge 56 of each tine 46 and terminate in a locking projection 58. The locking projections 58 extend inward from the inside edge 50 of each tine 46 such that, in the final assembly, the distance between the two locking projections 58 is less than the distance between the two inside edges 50 of the tines 46. The locking projections define an entry opening 60 that has a width that is less than the distance between the two inside edges 50 of the tines 46.

Figure 3:
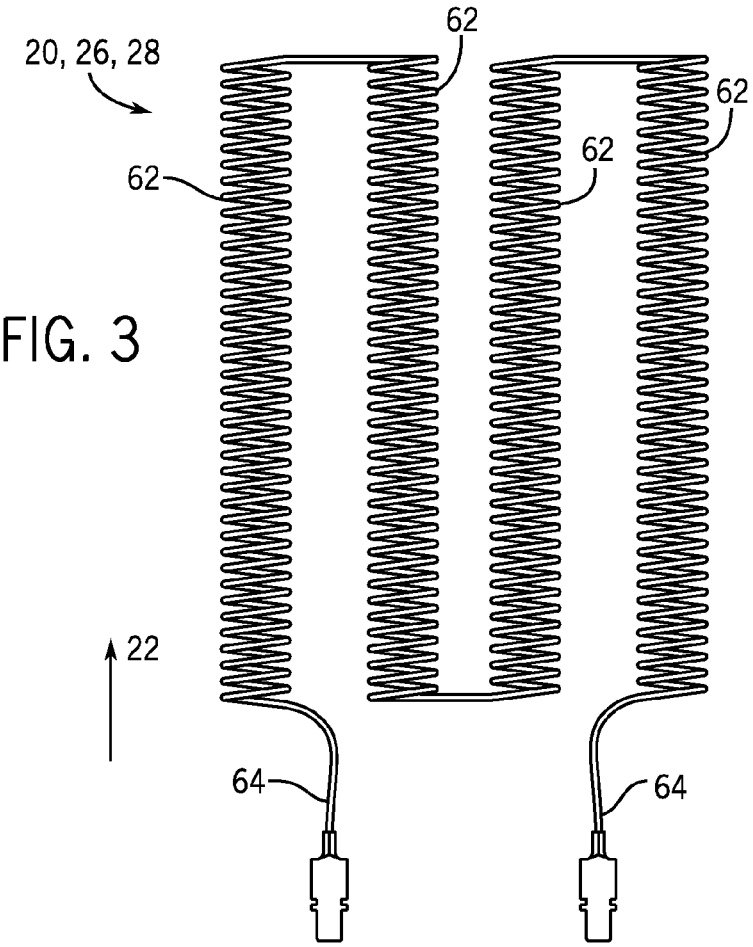
FIG. 3 is a plan view of a helical wire heating coil.

FIG. 3 depicts a heating coil that is representative of the first, second and third heating coils 20, 26, 28 shown in FIG. 1. The heating coils 20, 26, 28 are of continuous length and are disposed in four generally parallel coil sections 62 disposed in a common plane defined in the axial direction 20. The coils 20, 26, 28 have ends 64 attached to conventional terminal blocks 66 for connection to a source of electric current, as will be described further below.

Figure 5:
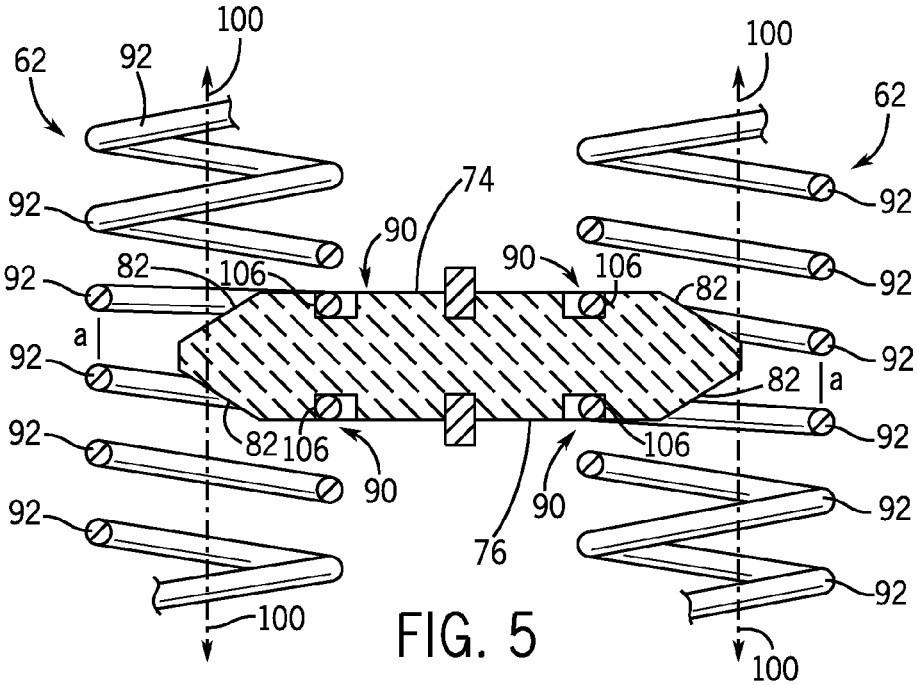
FIG. 5 is a side sectional view of an insulating standoff connected to helical wire heating coils.

FIGS. 4 and 5 depict insulating standoffs that are representative of the first and second pluralities of insulating standoffs 16, 18 shown in FIG. 1. The insulating standoffs 16, 18 are constructed in accordance with the insulating standoffs described in U.S. Pat. Nos. 5,954,983; 6,285,013; and 6,376,814, all of which are commonly owned with the present application. Each of the insulating standoffs 16, 18 is generally rectangular and is used to position the coil sections 62 away from the support frames 12, 14. In the example shown, the insulating standoffs are formed from ceramic such that they prevent current from flowing into the support frames 12, 14 from the coils 20, 26, 28. The insulating standoffs extend lengthwise in the lateral direction 24 between a first end 68 and a second end 70. Each of the insulating standoffs has a body portion 72 having a generally planar front face 74 and a generally planar back face 76. The front face 74 and the back face 76 are generally parallel and separated by a pair of edge surfaces 78 that define the overall thickness of the body portion 72 of the insulating standoff. Both the first end 68 and the second end 70 include a wedge portion 80. Each wedge portion 80 includes a pair of ramp surfaces 82 each of which are outwardly divergent from the first end 68 and the second end 70 to the respective front face 74 and back face 76. Both the first end 68 and the second end 70 are defined by a generally flat surface 84 that defines the point of the respective wedge portion 80. The width of each of the wedge portions 80 is defined by a pair of side surfaces 86 that are each spaced slightly inward from the edge surface 78, such that a shoulder 88 is formed between the surface 77 and the edge surface 78.

Each of the insulating standoffs includes four V-shaped coil grooves 90 that are used to retain the individual convolutions 92 of the respective heating coil 20, 26, 28. A pair of coil grooves is formed in the front face 74 of the insulating standoff, and a pair of coil grooves is formed in the back face 76 of the insulating standoff. Additionally, the coil grooves 90 are positioned such that one of the pair of the coil grooves formed in the front face 74 is positioned directly adjacent the wedge portion 80 formed on the first end 68 of the standoff and the second of the pair of coil grooves formed in the front face 74 is positioned directly adjacent the wedge portion 80 formed on the second end 70 of the standoff. The coil grooves 90 formed in the back face 76 are located in the same positions as the coil grooves 90 in the front face 74, such that the standoff has the same appearance when viewed from the front or back, or with the first end 68 up or the second end 70 up. This feature reduces the amount of labor required when assembling the heating element assembly, since it is immaterial how the standoff is oriented when mounted to the support frame 12, 14. In this manner, each of the standoffs is capable of supporting a coil section 62 near its first end 68 and a coil section 62 near its second end 70.

Each of the coil grooves 90 has a depth extending inwardly from either the front face 74 or the back face 76 of the insulating standoff. The coil grooves 90 are each defined by a pair of contact surfaces 92. The contact surfaces 92 are outwardly divergent from the centerline 94 of the standoff to the edge surfaces 78 of the standoff. Each of the contact surfaces 92 defines an abutment shoulder 94 at the intersection between the contact surface 92 and the edge surface 78. The abutment shoulder 94 is spaced slightly from the shoulder 88 defined between the side surface 86 of the wedge portion 80 and the edge surface 78 of the standoff.

Each of the coil grooves 90 includes a generally flat, recessed surface 98 which is spaced inwardly from either the front face 74 or the back face 76 of the standoff. The recessed surface 98 is preferably spaced inwardly by the height of the abutment shoulder 94 such that when the heating coil 20, 26, 28 is retained by the standoff, the depth of the coil groove 90 is approximately equal to the diameter of the wire forming the heating coil. In this manner, the outermost portion of the wire is approximately flush with the front face 74 and the back face 76 of the standoff when the coil section 62 is supported by the standoff.

The overall thickness of the insulating standoff between surfaces of the coil grooves 90 on the front face 74 and the back face 76 is greater than the distance "a" between individual convolutions 92 of the heating coil 20, 26, 28. In this manner, the inherent resiliency of the heating coil 20, 26, 28 along the longitudinal coil axis 100 extending lengthwise through any one of the coil sections 62 forces a pair of convolutions 92 of the respective coil section 62 into the pair of the coil grooves 90 formed in the standoff.

A retainer tab 102 is formed on each wedge portion 80. The retainer tab 102 is a generally semi-circular projection extending from the wedge portion 80 into the V-shaped coil groove 90. The retainer tab 102 generally extends into the coil groove 90 such that the portion of the retainer tab 102 extending furthest from either the first end 68 or the second end 70 of the standoff is generally aligned with the trough of the coil groove 90. In a preferred embodiment, the outer edge surface of the retainer tab 102 is spaced from the contact surfaces 106 defining the coil groove 90 by a distance sufficient to allow the wire defining the heating coil 20, 26, 28 to be positioned between the retainer tab 102 and the contact surfaces 106 of the coil groove 90.

Each of the insulating standoffs includes a pair of attachment slots 108. One of the attachment slots 108 is formed in the front face 74 and one of the attachment slots 108 is formed in the back face 76. The attachment slots 108 extend across the entire front face 74 and back face 76, respectively, at approximately the midpoint of the standoff between the first end 68 and the second end 70. The attachment slots 108 extend into the standoff such that the thickness of the standoff between the innermost surfaces of the attachment slots 108 is approximately the same as the distance between the inside edges 50 of the tines 46. The width of the standoff between the front face 74 and the back face 76 is greater than the width of the open slot 48 but less than the distance between the outer edges 56 of the tines 46. In this manner, the pair of tines 46 on each arm 42 can support the insulating standoff when the standoff is positioned within the open slot 48.

Figure 6:
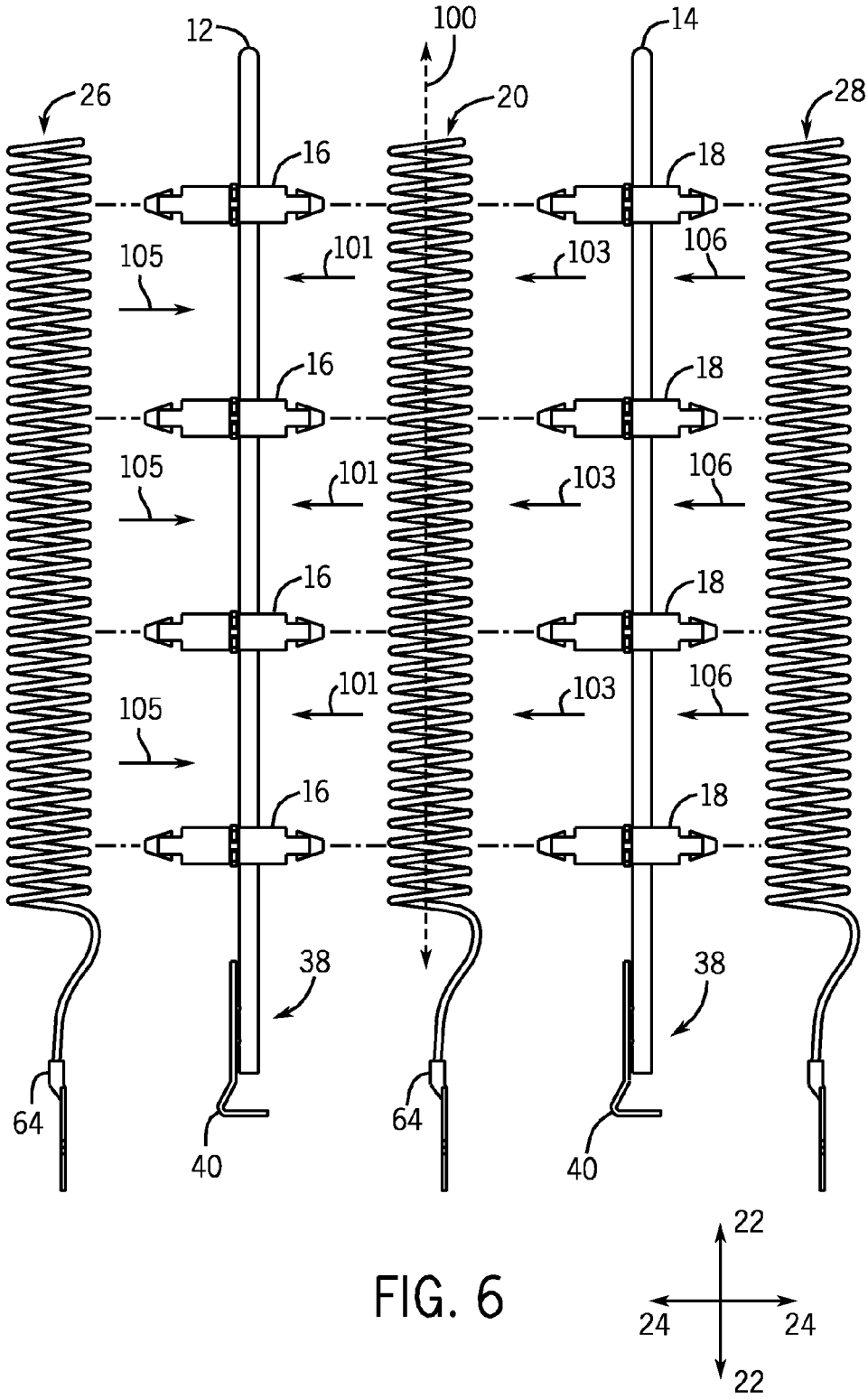
FIG. 6 is a side view depicting assembly of a helical wire heating coil assembly.
Figure 7:
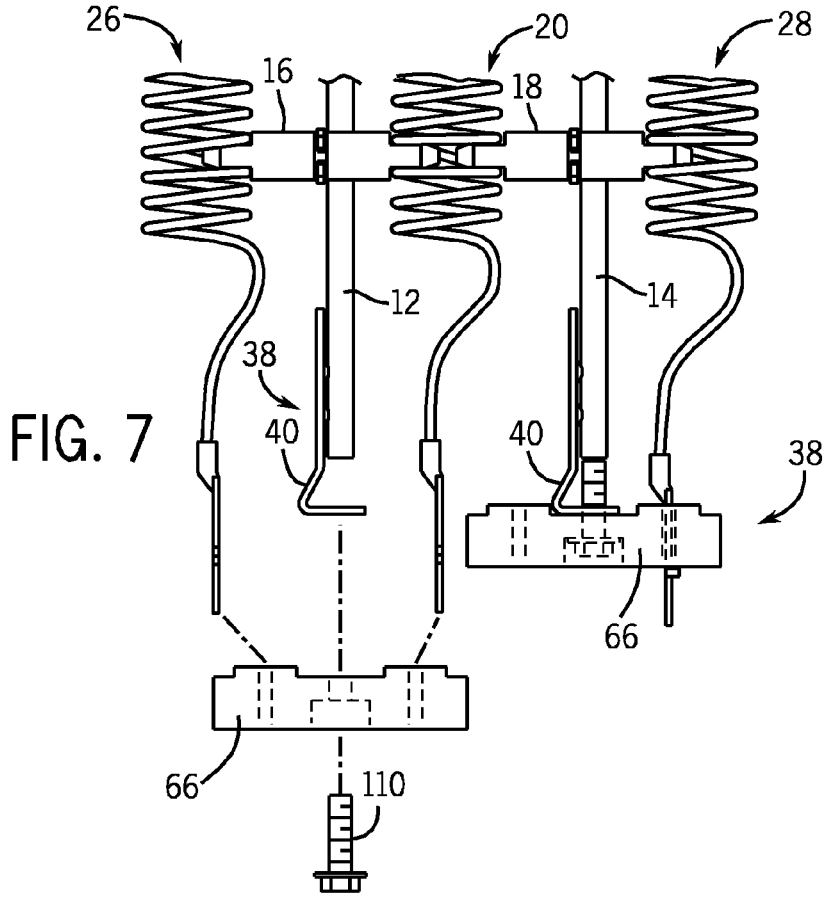
FIG. 7 is a view of terminal blocks being connected to end portions of a support frame.
Figure 8:
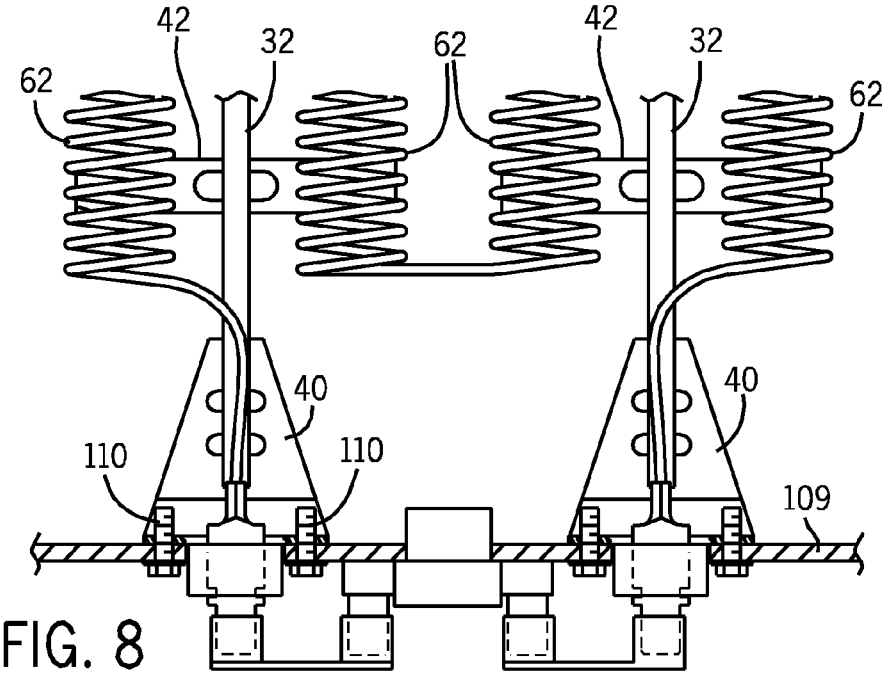
FIG. 8 is a view of a support frame connected to a mounting surface.

Referring to FIGS. 4-6, the helical wire heating assembly 10 can be assembled as follows. As shown in FIG. 4, the first and second pluralities of standoffs 16, 18 are coupled to the first and second frames 12, 14, respectively. Each standoff in the respective pluralities 16, 18 is positioned between the pair of tines 46 on the arms 42 with the tines 46 being formed initially to angle outwardly. The tines 46 are angled outwardly to a sufficient degree such that the distance between the locking projections 58 is greater than the thickness of the standoff between the pair of attachment slots 108. With the tines 46 sufficiently separated, the standoff can be inserted therebetween. The tines 46 are then bent towards each other such that the tines 46 are received in the attachment slots 108 formed in the standoff. When the tines 46 are bent to their final assembled position, the locking projections 58 prevent the insulating standoff from exiting the open slot 48 through the entry opening 60.

As shown in FIGS. 5 and 6, the first helical wire heating coil 20 is then coupled to the first support frame 12 via the first plurality of insulating standoffs 16. Initially, the first end of each insulating standoff in the plurality 16 is positioned between a pair of convolutions 92 of the coil section 62, such that the coil axis 100 is perpendicular to the longitudinal axis of the standoff. With the standoff positioned as such, the coil section 62 and the standoff are pressed into contact with each other (arrows 101; FIG. 6). As the contact force is continuously applied, the convolutions 92 of the heating coil 20 travel down the angled ramp surfaces 82 such that the convolutions 92 of the coil section 62 are separated. When the convolutions 92 are separated by the distance equal to the width of the standoff, the standoff is further pressed upward into the coil section 62 until the convolutions enter the coil grooves 90 between the retainer tab 102 and the contact surfaces 106.

When each insulating standoff in the plurality 16 has been pushed far enough into the coil section 62, the inherent resiliency of the heating coil 20 in the direction of the coil axis 100 forces the convolutions 92 into each of the coil grooves 90 formed on the front face 74 and the back face 76. Once the convolutions 92 of the coil section 62 are within the coil grooves 90, the standoff holds the coil section 62 in place. The inherent compressive force of the helical heating coil 20 prevents the coil section 62 from becoming dislodged in the direction of the coil axis 100, while the three points of contact between the heating coil 20 and the retainer tab 102 and contact surfaces 106 prevent the coil section 62 from moving laterally with respect to the longitudinal axis of the standoff. In this manner, the standoff securely holds the coil section 62 in place with respect to the standoff.

Next, the second support frame 14 containing the second plurality of standoffs 18 is aligned next to the first support frame 12 on the side of the first helical wire heating coil 20 and so that the second plurality of insulating standoffs 18 is positioned adjacent the convolutions 92 of the first helical wire heating coil 20. The second support frame 14 is then moved in the lateral direction 24 towards the first heating coil frame 12 until the second plurality of insulating standoffs 18 on the second support frame 14 snap-engage with the heating coil 20. Specifically, the first end of each insulating standoff in the second plurality 18, specifically the flat surface 84, is positioned between a pair of the individual convolutions of the coil section 62, such that the coil axis 100 is perpendicular to the longitudinal axis of the standoff. With the standoff positioned as such, the coil section 62 and the standoffs 18 on frame 14 are pressed into contact with each other (arrows 103; FIG. 6) in one simple movement in the lateral direction 24. As the contact force is continuously applied, the convolutions 92 of the heating coil 20 travel down the angled ramp surfaces 82 such that the convolutions 92 of the coil section 62 are separated. When the convolutions 92 are separated by the distance equal to the width of the standoff, the standoff is further pressed upward into the coil section 62 until the convolutions enter the coil grooves 90 between the retainer tab 102 and the contact surfaces 106.

When each insulating standoff in the second plurality 18 has been pushed far enough into the coil sections 62, the inherent resiliency of the heating coil 20 in the direction of the coil axis 100 forces the convolutions 92 into each of the coil grooves 90 formed on the front face 74 and the back face 76. Once the convolutions 92 of the coil section 62 are within the coil grooves 90, the standoff holds the coil section 62 in place. The inherent compressive force of the helical heating coil 20 prevents the coil section 62 from becoming dislodged in the direction of the coil axis 100, while the three points of contact between the heating coil 20 and the retainer tab 102 and contact surfaces 106 prevent the coil section 62 from moving laterally with respect to the longitudinal axis of the standoff. In this manner, the standoff securely holds the coil section 62 in place with respect to the standoff, thus coupling the first support frame 12 to the second support frame 14 via the heating coil 20. The unique design of the standoff and frames allow the first frame 12 to be coupled to the second frame 14 in one simple motion in the lateral direction. The plurality of standoffs 18 are aligned with the coil 20 in such a manner that all of the standoffs 18 simultaneously or substantially simultaneously "snap" into engagement with the convolutions 92 in a uniform manner, thus assuring that the frames 12, 14 are properly and securely coupled together. The assembly 10 is thus much easier to assemble than prior art assemblies in a cost-effective procedure.

As shown in FIG. 1, the second and third helical wire heating coils 26, 28 are then attached to the opposite ends of the first and second pluralities of insulating standoffs 16, 18, respectively, in a manner similar to that described above for connection between the first support frame 12 and the heating coil 20 (arrows 105, 107; FIG. 6). It will be understood by those skilled in the art that the assembly described herein can include additional support frames, pluralities of insulating standoffs, and/or heating coils. In addition, the support frames and helical wire heating coils can include additional axial lengths and coil sections, respectively, to form a wider assembly in the radial direction and/or a taller assembly in the lateral direction. The coil sections can also be longer and include more standoffs to form a longer assembly in the axial direction.

FIG. 6 depicts the end portions 38 which include the angled support bracket 40 that is used as a point of attachment for the assembly within an appliance, a heating duct or the like. The angled support brackets 40 facilitate mounting of the assembly to terminal blocks 66 and to a mounting structure such as a base plate 109, which can be part of a module that is easily installed and/or removed from the appliance, heating duct, or the like by screws 110. This eliminates the need for welding or other expensive, time consuming installation processes.

Constructing the assembly shown and described is a rather simple and easy process requiring minimal work. In this manner, the assembly shown in the Figures is a vast improvement over presently available support structures which often require complex mounting arrangements. The assembly shown and described facilitates a compact design with multiple heating coil sections arranged in a compact, modular unit. The assembly also eliminates unnecessary frame members, such as end connectors, which saves cost and time of assembly. The method of assembling described above is easy to follow and requires minimal steps when compared to the prior art.

In use, the assembly 10 can be installed as a modular unit in an appliance, heating duct or the like. The unique combination of structure including the U-shaped support frames 12, 14 and insulating standoffs 16, 18 described above allow the assembly to have a compact size and shape, while maximizing the amount of heating coil exposed to air flow. Thus, the assembly 10 shown and described hereinabove works to more efficiently heat through-flowing air.

What is claimed is:

1. A helical wire heating coil assembly wherein the assembly extends in an axial direction, a lateral direction that is perpendicular to the axial direction, and a radial direction that is perpendicular to the axial direction and perpendicular to the lateral direction; the assembly comprising first and second support frames, a first plurality of insulating standoffs coupled to the first support frame, a second plurality of insulating standoffs coupled to the second support frame, and a helical wire heating coil coupled to both the first plurality of insulating standoffs and the second plurality of insulating standoffs, wherein the helical wire coil assembly is disposed between the first support frame and second support frame in the lateral direction and detachably holds the first and second support frames together.

2. The helical wire heating coil assembly of claim 1, wherein the first and second support frames and the helical wire heating coil extend in the axial direction, wherein the first and second pluralities of insulating standoffs extend from the first and second support frames, respectively, in the lateral direction.

3. The helical wire heating coil assembly of claim 2, wherein each of the first and second support frames comprise a plurality of arms for supporting the insulating standoffs, each arm extending in the radial direction.

4. The helical wire heating coil assembly of claim 3, comprising arms extending to one side of the first and second support frames in the radial direction and arms extending to the other side of the first and second support frames in the radial direction.

5. The helical wire heating coil assembly of claim 3, further comprising a third support frame that is detachably coupled to the first and second support frames by a third plurality of standoffs coupled to the third support frame and a second helical wire heating coil coupled to both the second plurality of insulating standoffs and the third plurality of insulating standoffs.

6. The helical wire heating coil assembly of claim 1, further comprising second and third helical wire heating coils coupled to the first and second pluralities of insulating standoffs, respectively.

7. The helical wire heating coil assembly of claim 1, wherein the first and second support frames comprise a U-shaped rail having a first closed end and a second open end having two end portions.

8. The helical wire heating coil assembly of claim 7, comprising a terminal block on each end portion, the terminal block adapted to connect to a source of electric current and provide said current to the helical sire heating coil.

9. The helical wire heating coil assembly of claim 8, comprising a flange supporting connection of the terminal block to the end portions.

10. The helical wire heating coil assembly of claim 1, wherein each of the insulating standoffs comprises an elongated body portion extending between first and second ends, the body portion having a front face and a back face;

a wedge portion formed on the first and second ends of the body portion, the wedge portion having a pair of angled ramp surfaces converging from the respective front and back faces of the body; and a coil groove formed in each of the front and back faces of the body, the coil groove being located adjacent the wedge portion.

11. The helical wire heating coil assembly of claim 10, wherein the coil groove is formed by a V-shaped contact surface and a curved retainer surface, the coil groove being sized to receive a convolution of the heating coil and to provide two-point contact between the contact surface and the outside edge of the convolution and one-point contact between the retainer surface and the inner edge of the convolution.

12. The helical wire heating coil assembly of claim 11, wherein the V-shaped coil groove is defined by a pair of contact surfaces, the contact surfaces being positioned at an angle with respect to each other.

13. The helical wire heating coil assembly of claim 11, further comprising an attachment slot formed in both the front face and the back face of the body portion between the first end and the second end of the body portion.

14. The helical wire heating coil assembly of claim 11, wherein the coil groove includes a flat recessed surface lying in a plane generally perpendicular to the coil axis.

15. A method for assembling a helical wire coil heating assembly comprising the steps of:

(a) providing a plurality of insulating standoffs;

(b) providing first and second support frames having arms for holding insulating standoffs;

(c) coupling standoffs from the plurality onto each of the arms;

(d) providing a helical wire heating coil;

(e) coupling each of the standoffs on the first support frame to the helical wire heating coil; and (f) coupling each of the standoffs on the second support frame to the helical wire heating coil to thereby releasably hold the first support frame and the second support frame together.

16. The method of claim 15, wherein the first and second support frames extend along the axial direction; wherein the standoffs on the first frame extend upwardly in the lateral direction; wherein the standoffs on the second frame extend downwardly in the lateral direction; and wherein the helical wire heating coil extends in the axial direction between the first and second support frames.

17. The method of claim 16, wherein step (f) is completed by moving the second support frame in the lateral direction towards the heating coil on the first support frame until the insulating standoffs on the second support frame snap engage with the heating coil.

18. The method of claim 17, wherein each of the insulating standoffs comprises an elongated body portion extending between first and second ends, the body portion having a front face and a back face;

a wedge portion formed on the first and second ends of the body portion, the wedge portion having a pair of angled ramp surfaces converging from the respective front and back faces of the body; and a coil groove formed in each of the front and back faces of the body, the coil groove being located adjacent the wedge portion.

19. The method of claim 18, wherein the coil groove is formed by a V-shaped contact surface and a curved retainer surface, the coil groove being sized to receive a convolution of the heating coil and to provide two-point contact between the contact surface and the outside edge of the convolution and one-point contact between the retainer surface and the inner edge of the convolution.

20. The method of claim 17, further comprising the step of attaching one end of both the first and second support frames to a base member.

* * * * *